US005471930A

United States Patent [19]

Wood

[11] Patent Number: 5,471,930

[45] Date of Patent: Dec. 5, 1995

[54] RUBBER STAMP FOR USE WITH DIFFERENT COLORED INKS

[76] Inventor: Lawson A. Wood, 905 N. Frederick St., Arlington, Va. 22205

[21] Appl. No.: 354,026

[22] Filed: Dec. 6, 1994

[51] Int. Cl.[6] ..... B41K 1/56

[52] U.S. Cl. ..... 101/405; 101/372

[58] Field of Search ..... 101/405, 406, 101/373, 372, 371, 368, 327, 109, 103, 333

[56] References Cited

U.S. PATENT DOCUMENTS

| | | | |
|---|---|---|---|
| 778,386 | 8/1904 | Tenney | 101/373 |
| 2,835,196 | 5/1958 | Herbert et al. | 101/333 |
| 4,291,622 | 9/1981 | Bengtsson | 101/405 |

FOREIGN PATENT DOCUMENTS

| | | | |
|---|---|---|---|
| 2847524 | 5/1980 | Germany | 101/368 |

*Primary Examiner*—Edgar S. Burr
*Assistant Examiner*—Anthony H. Nguyen

[57] ABSTRACT

A rubber stamp which can used with different colored inks includes a hollow holder having a base. A first stamp portion is mounted on the base. A plunger extends through the holder and carries a second stamp portion. The second stamp portion can be moved between a raised position which is above the first stamp portion and a lowered position which is below the first stamp portion. A spring may be used to bias the second stamp portion in its raised position. In use, the rubber stamp is wetted with ink having a first color by pressing the first stamp portion against a first stamp pad while the second stamp portion is in its raised position. Then the plunger is depressed to move the second stamp portion to its lowered position. The second stamp portion can then pressed against a second ink pad to wet it with ink of a second color. A two-colored image can then applied to a surface such as a greeting card by pressing the rubber stamp against the greeting card and then pressing the plunger.

8 Claims, 1 Drawing Sheet

RUBBER STAMP FOR USE WITH DIFFERENT COLORED INKS

BACKGROUND OF THE INVENTION

The present invention relates to a rubber stamp, and more particularly to an ornamental rubber stamp of the type used by hobbyists for decorative purposes.

A typical rubber stamp has a holder with a flat base. A cushion of a material such as foam rubber is adhesively attached to the base of the holder, and a resilient mat with a raised design is adhesively attached to the cushion. The resilient mat is typically made of an elastomer material, and rubber may be used for this purpose. However, the term "rubber stamp" as used in the present document does not imply that rubber must necessarily be present in the resilient mat. The top side of the holder may be provided with a handle, or the holder itself may be manually grasped by the person holding the rubber stamp.

The raised design on the resilient mat may have a utilitarian purpose. For example, the raised design may include alphanumeric characters for a return address or the message "paid" or "first class mail." Alternatively, the raised design may have a decorative purpose. For example it may depict an individual visual element such as a flower or a bird, or it may depict a scene which includes a combination of visual elements.

Decorative rubber stamps are becoming increasingly popular among hobbyists. Using an assortment of rubber stamps, a hobbyist can create a personalized scene on a greeting card, for example. Ink pads are available in a variety of colors for use by hobbyists. The hobbyist selects a stamp and an ink pad of the desired color, presses the rubber stamp against the ink pad to transfer ink to the raised design, and then presses the rubber stamp against the greeting card to transfer an image corresponding to the raised design to the greeting card. Using this technique, the image created during a single stamping operation has a single color. Ink pads which carry inks of different colors in different regions of the pad (so-called "rainbow" pads) are commercially available in order to permit a multi-colored image to be created during a single stamping operation. While the resulting images are not as bland as single-colored images, the color pattern received from the pad generally has nothing to do with the image itself.

In order to use a rubber stamp to create an image with colors that conform to the image, it is common for hobbyists to abandon ink pads altogether and turn instead to felt-tip markers. The hobbyist uses the markers to transfer ink to different portions of the raised design of a stamp, and then presses the raised design against a greeting card or other record carrier. For example, a hobbyist might use a green marker to color the leaves and stem of a flower and a red marker to color the flower itself. A red flower with a green stem and leaves could then be stamped onto a greeting card or other surface.

The problem with this technique for creating multi-colored images is that it is a time-consuming and exacting task to use felt-tip markers to color individual portions of the raised design of a rubber stamp.

SUMMARY OF THE INVENTION

An object of the present invention is to provide a rubber stamp which is easier to ink with different colors than prior art rubber stamps.

Another object of the invention is to provide a rubber stamp having a first stamp portion which can be inked by pressing it against a first ink pad and having a second stamp portion which can be inked by pressing it against a second stamp pad, the second stamp portion being movable with respect to the first stamp portion.

These and other objects which will be apparent from the ensuing detailed description can be obtained by providing a rubber stamp which includes a holder having a base, a first stamp portion which is mounted on the base, a second stamp portion, and means for movably mounting the second stamp portion on the holder, the second stamp portion being movable between a raised position which is above the first stamp portion and a lowered position which is below the first stamp portion. The first and second stamp portions can then be wetted with inks having different colors. The first and second stamp portions cooperate to form a composite, multi-colored image.

DESCRIPTION OF THE PREFERRED EMBODIMENT

Figure 1:
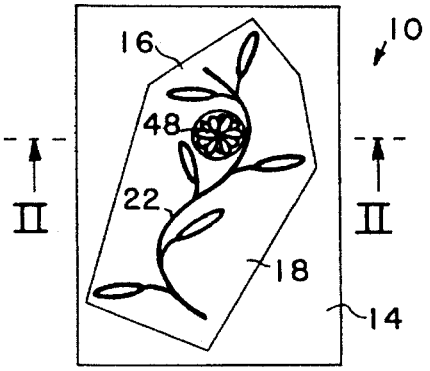
FIG. 1 is a bottom plane view of a rubber stamp in accordance with the present invention.
Figure 2:
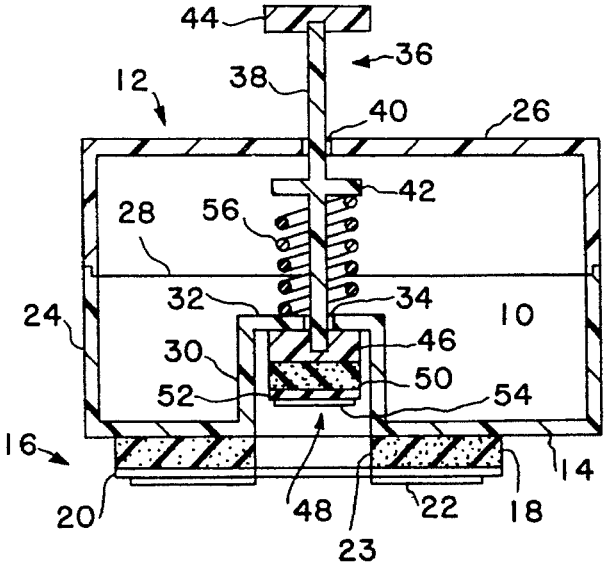
FIG. 2 is a cross-sectional view taken along the line II—II of FIG. 1.

FIGS. 1 and 2 illustrate a rubber stamp 10 in accordance with the present invention. It includes a holder 12 having a base 14. A first stamp portion 16 is mounted on the base 14. First stamp portion 16 includes a cushion 18 of elastomer foam material and a mat 20 of a resilient elastomer material, which may be rubber. However, as was noted previously, the term "rubber stamp" as used in this document does not mean that mat 20 is necessarily made of rubber. Cushion 18 is adhesively attached to base 14 and mat 20 is adhesively attached to cushion 18. The bottom side of mat 20 has a raised design 22, in this case depicting leaves and a stem. An opening 23 is provided in first stamp portion 16.

Holder 12 is formed from a bottom shell 24 and a top shell 26 which are adhesively connected along a joint 28. Bottom shell 24 has a well 30 with a bottom wall 32 in it. Well 30 is aligned with the opening 23 in first stamp portion 16. An opening 34 is provided in the well bottom wall 32.

A plunger 36 includes a stem 38 which extends through the opening 34 and through an opening 40 in top shell 26. A disk-shaped abutment member 42 is provided on stem 38. Plunger 36 also includes a disk-shaped operating member 44 which is adhesively attached to the top end of stem 38 and a disk-shaped plunger base 46 which is adhesively attached to the bottom end.

Plunger base 46 carries a second stamp portion 48, which includes a cushion 50 that is adhesively attached to plunger base 46 and a resilient mat 52 that is adhesively attached to the cushion 50. Mat 52 has a raised design 54, in this case depicting a flower.

A spring 56 is disposed between abutment member 42 and bottom wall 32 to bias the second stamp portion 48 in a raised position with respect to the first stamp portion 16. However, second stamp portion 48 can be moved through opening 23 to a lowered position by pressing plunger 36.

Figure 3:
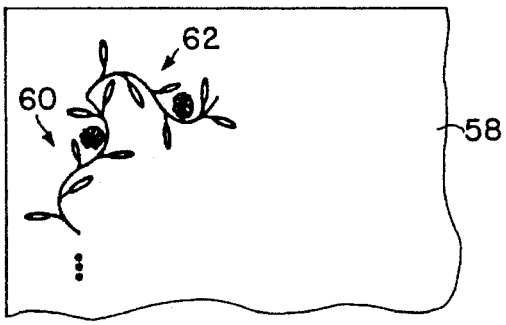
FIG. 3 is a top plane view of a corner of a greeting card, and illustrates two segments of a border which is being made by a hobbyist using the stamp of FIG. 1.
Figure 6:
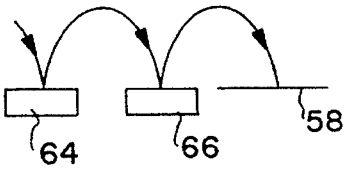
FIG. 6 schematically illustrates steps in the use of the stamp shown in FIG. 1.
Figure 4:
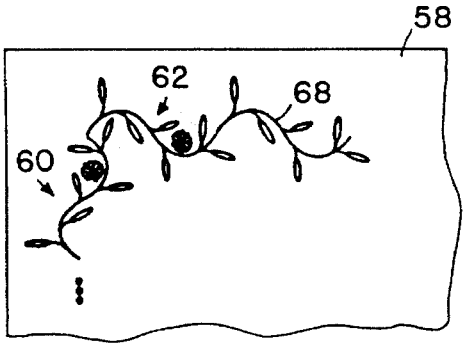
FIG. 4 is a top plane view of the card of FIG. 3, and additionally shows part of a further segment that is made using the stamp of FIG. 1.
Figure 5:
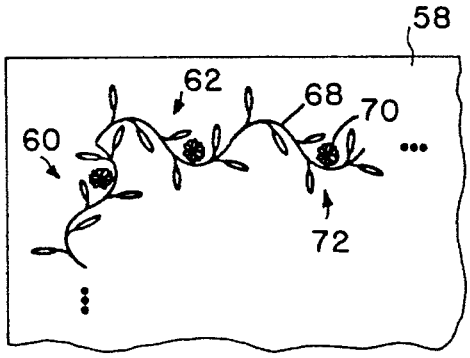
FIG. 5 is a top plane view of the card of FIG. 4, and additionally shows completion of the further segment using the stamp of FIG. 1.

Turning next to FIGS. 3–6, how rubber stamp 10 can be used by a hobbyist to create multi-colored images on a record carrier such as greeting card 58 will now be described. In this example, the multi-colored images are segments of a border for the card 58. In FIG. 3, two segments 60 and 62 of the border have already been created. To create the next segment, the hobbyist grasps the holder 12 and presses first stamp portion against a green stamp pad 64 while the second stamp portion 48 is in its raised position. After the raised design 22 of the first stamp portion 16 has been wetted with green ink, the hobbyist depresses operating member 44 in order to shift second stamp portion 48 to its lowered position. In its lowered position, second stamp portion 48 is disposed below first stamp portion 16. This permits the hobbyist to press second stamp portion 48 against a red stamp pad 66 without getting red ink on first stamp portion 16. The hobbyist then releases operating member 44, whereupon second stamp portion 48 is returned to its raised position by spring 56. The hobbyist then moves rubber stamp 10 to a position above card 58 and carefully aligns it with segment 62 of the border. The hobbyist then presses rubber stamp 10 against card 58 to form a first part 68 of the next segment, as shown in FIG. 4. Then the hobbyist presses operating member 44 to lower second stamp portion 48 against card 58 and thereby form the second part 70 of the next segment as shown in FIG. 5. The completed segment, which is identified by reference number 72 in FIG. 5, includes a serpentine green vine provided by first portion 68 and a red flower which is nestled among the leaves of the vine and provided by second part 70. The groups of three dots in FIGS. 3–5 are intended to indicate that further segments are added to the border in the same way.

While rubber stamp 10 has only one second stamp portion 48, it will be apparent that further second stamp portions could be used in order to permit images with more than two colors to be made during a single stamping operation or in order to permit second stamp portions to cooperate in forming a relatively complicated portion of the image even if a single color is used for that portion. It will also be apparent that second stamp portion 48 can be biased upward by means other than the coil spring 56. For example, a leaf spring which is attached to one of the shells 24 and 26 and which engages the bottom side of abutment member 42 could be used. Another alternative would be a rubber band which is supported by hooks molded into the upper portion of top shell 26 and which is connected to stem 38. The tubular foam member which is disposed between well bottom wall 32 and abutment member 42 would be another possibility.

It will be understood that the above description of the present invention is susceptible to various other modifications, changes, and adaptations, and the same are intended to be comprehended within the meaning and range of equivalents of the appended claims.

What I claim is:

1. A rubber stamp, comprising:

a hollow holder having a base and having a top wall which is fixedly disposed over the base at a position spaced apart from the base, the holder additionally having a well which is fixedly connected to the base and which protrudes toward the top wall, the well terminating at a bottom wall which is disposed at a fixed position between the base and the top wall, the bottom wall of the well having an opening and the top wall having an opening which aligned with the opening in the bottom wall of the well;

a first stamp portion mounted on the base;

a second stamp portion;

mounting means for movably mounting the second stamp portion on the holder so that the second stamp portion is movable between a raised position which is above the first stamp portion and a lowered position which is below the first stamp portion, the second stamp portion being located in the well when it is in its raised position, the mounting means including a plunger which movably extends through the opening in the top wall of the holder and the opening in the bottom wall of the well, the plunger having an abutment which is located between the openings; and biassing means, inside the housing and engaging the abutment, for biassing the second stamp portion in its raised position.

2. The rubber stamp of claim 1, wherein the biassing means comprises a spring which engages both the abutment and the bottom wall of the well.

3. The rubber stamp of claim 1, wherein the biassing means comprises a spring.

4. The rubber stamp of claim 1, wherein the holder comprises a bottom shell and a top shell, the base of the holder and the well being provided on the bottom shell.

5. The rubber stamp of claim 1, wherein the abutment has a width and the openings in the top wall of the housing and the bottom wall of the well have respective widths, and wherein the width of the abutment is greater than the width of either of the openings.

6. The rubber stamp of claim 5, wherein the plunger has a top end and a bottom end and is provided with a plunger base at the bottom end thereof, the plunger base being disposed inside the well, the plunger base having a width that is greater than the width of the opening in the bottom wall of the well.

7. The rubber stamp of claim 6, further comprising an operating member at the top end of the plunger, the operating member having a width that is greater than the width of the opening in the top wall of the housing.

8. A stamping method which comprises the steps of:

(a) providing a rubber stamp which includes a hollow holder having a base and having a top wall which is fixedly disposed over the base at a position spaced apart from the base, the holder additionally having a well which is fixedly connected to the base and which protrudes toward the top wall, the well terminating at a bottom wall which is disposed at a fixed position between the base and the top wall, the bottom wall of the well having an opening and the top wall having an opening which is aligned with the opening in the bottom wall of the well, the rubber stamp additionally including first and second stamp portions, the first stamp portion being mounted on the base, the rubber stamp further including mounting means for movably mounting the second stamp portion on the holder so that the second stamp portion is movable between a raised position which is above the first stamp portion and a lowered position which is below the first stamp portion, the second stamp portion being located in the well when it is in its raised position, the mounting means including a plunger which movably extends through the opening in the top wall of the holder and the opening in the bottom wall of the well, the plunger having an abutment which is located between the openings, the rubber stamp also including biassing means, inside the housing and engaging the abutment, for biassing the second stamp portion in its raised position;

(b) pressing the holder toward a first stamp pad to ink the first stamp portion while the second stamp portion is in its raised position, inside the well;

(c) pressing the plunger to deform the biassing means within the holder and move the second stamp portion to its lowered position;

(d) pressing the holder toward a second stamp pad to ink the second stamp portion but not the first stamp portion while the second stamp portion is in its lowered position; and (e) pressing the holder toward a record carrier and pressing the plunger to move the second stamp portion to an intermediate position between its raised and lowered positions, to print on the record carrier a composite image formed by the first stamp portion and the second stamp portion.

* * * * *